US005305001A

United States Patent [19]

Wong et al.

[11] Patent Number: 5,305,001

[45] Date of Patent: Apr. 19, 1994

[54] HORN RADIATOR ASSEMBLY WITH STEPPED SEPTUM POLARIZER

[75] Inventors: Mon N. Wong; Gregory D. Kroupa, both of Torrance, Calif.

[73] Assignee: Hughes Aircraft Company, Los Angeles, Calif.

[21] Appl. No.: 906,162

[22] Filed: Jun. 29, 1992

[51] Int. Cl.[5] ..... H01P 1/16

[52] U.S. Cl. ..... 343/786; 343/756; 333/21 A

[58] Field of Search ..... 333/21 A, 21 R, 121, 333/122, 125, 126, 135, 137, 246; 343/786, 756, 772

[56] References Cited

U.S. PATENT DOCUMENTS

| | | | |
|---|---|---|---|
| 3,922,621 | 11/1975 | Gruner | 333/21 R |
| 3,958,192 | 5/1976 | Rootsey | 333/21 A |
| 3,958,193 | 5/1976 | Rootsey | 333/21 A |
| 4,126,835 | 11/1978 | Gould | 333/21 A |
| 4,568,943 | 2/1986 | Bowman | 333/21 A |

*Primary Examiner*—Raymond A. Nelli

*Attorney, Agent, or Firm*—William J. Streeter; Wanda K. Denson-Low

[57] ABSTRACT

A circularly polarized wave entering the horn is converted to a linearly polarized wave which appears in one of the ports depending on the sense of the polarization. The stepped configuration of the impedance matching section minimizes mutual coupling among horns of the respective assemblies of the array antenna.

11 Claims, 5 Drawing Sheets

FIG. 19.

SEPTUM

REGION

OMT

SEPTUM

REGION

OMT

HORN RADIATOR ASSEMBLY WITH STEPPED SEPTUM POLARIZER

BACKGROUND OF THE INVENTION

This invention relates to a microwave horn radiator assembly for radiating circularly polarized electromagnetic waves from a radiator at a front portion of the assembly, the assembly including an orthomode transducer providing a conversion between linearly and circularly polarized radiation. More particularly, the invention employs a septum increasing stepwise monotonically in height from a bottom wall to a top wall of a square waveguide to provide two rectangular waveguide ports at a back end of the assembly, opposite the horn radiator, to provide the conversion between linearly and circularly polarized radiation. The assembly also includes plural stepped waveguide sections forming an impedance matching section behind the horn radiator, and a set of capacitive posts between the matching section and the septum.

An antenna comprising an array of radiators providing circularly polarized radiation may be employed in numerous situations, including a mounting of the antenna on board a spacecraft to provide for communication between the spacecraft and a station on the earth. In the construction of the antenna, each of the radiators is formed as a part of a radiator assembly which includes microwave structures for converting a linearly polarized electromagnetic wave to a circularly polarized electromagnetic wave for transmission of a microwave signal, and for converting from circularly polarized radiation to linearly polarized radiation upon reception of a microwave signal. It has been the practice to employ an orthomode transducer to provide for the conversion between the linearly and circularly polarized radiation. The microwave structure for polarization conversion is substantially larger than the radiator itself. In a typical construction of orthomode transducer, perpendicularly oriented rectangular waveguides have been employed to provide for both right-hand and left-hand circularly polarized waves.

A problem arises in that the foregoing construction is inconvenient because of the excessively large size required of the microwave structure, including the orthomode transducer, which feeds electromagnetic power to the radiator, and which receives incoming signals from the radiator for each of the radiators of the array antenna. A further disadvantage in the foregoing construction is excessive complexity in the manufacturing process required to produce the microwave structure. Also, it is noted that a large bandwidth is advantageous in the use of communication equipment, and the foregoing construction has been disadvantageous in respect to a limitation of the maximum bandwidth available for communication. The physical size has been enlarged also because of a need for numerous tuning screws, the need for such tuning also complicating the manufacture and set-up procedure. Also, the radiator should be operated in such a fashion as to minimize mutual coupling between signals of the various radiators of the antenna array.

SUMMARY OF THE INVENTION

The aforementioned problems are overcome and other advantages are provided by a multiple-band horn radiator assembly and an antenna comprising an array of such horn radiator assemblies which incorporate the invention to provide sufficient bandwidth to combine functions of transmit, receive, and tracking frequencies in each horn radiator assembly. The construction of the invention minimizes hardware, reduces weight, and saves manufacturing time.

Each horn radiator assembly comprises a waveguide section of square cross-section arranged coaxially with a circular cylindrical horn. The horn provides a radiating aperture for radiation of circularly polarized electromagnetic waves. The waveguide section is coupled via an impedance matching section to the horn radiator. Within the waveguide section, and extending in the direction of a longitudinal axis of the waveguide section, there is provided a septum which increases gradually in height from the bottom wall to the top wall via a series of steps with progression in a direction away from the horn radiator. At the maximum height of the septum, the septum extends from the bottom wall to a top wall of the waveguide section and bisects a rear portion of the waveguide section into two rectangular waveguides which serve as input ports of an orthomode transducer for injecting linearly polarized radiation to be converted to either right or left-handed circularly polarized waves. The septum introduces a phase-shift characteristic of decreasing phase shift with increasing frequency. This phase-shift characteristic is counterbalanced by a line of capacitive teeth disposed on the bottom wall in front of the septum to provide a phase-shift characteristic wherein phase shift increases with increasing frequency. The diameter of the horn radiator is larger than the height of a sidewall of the waveguide section, and the impedance matching section comprises two waveguide sections of decreasing cross-sectional sides wherein a forward section connecting with the horn is circular and a back section connecting with the aforementioned waveguide section is square in cross section.

BRIEF DESCRIPTION OF THE DRAWING

The aforementioned aspects and other features of the invention are explained in the following description, taken in connection with the accompanying drawing wherein.

DETAILED DESCRIPTION

Figure 1:
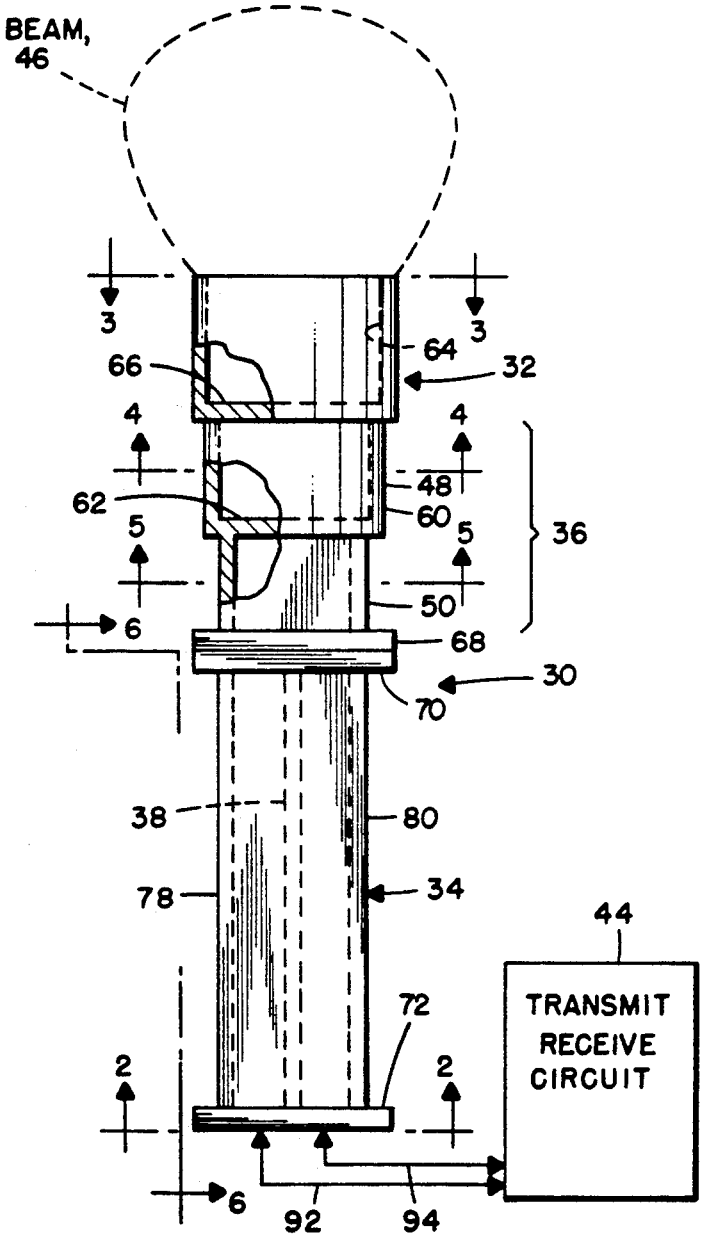
FIG. 1 shows a top plan view of a horn radiator assembly of the invention, with portions of the assembly being cut away to show interior constructional details.
Figure 6:
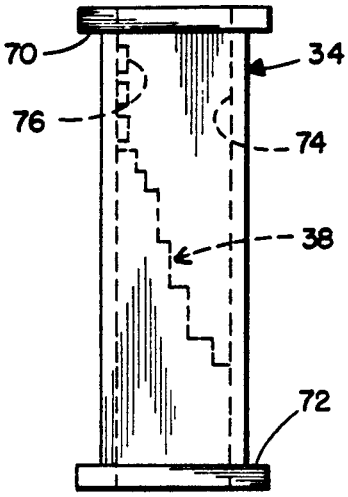
FIG. 6 is a side elevational view, taken along the line 6—6, of the assembly of FIG. 1 with a septum and a set of capacitive teeth being indicated in phantom view.
Figure 2:
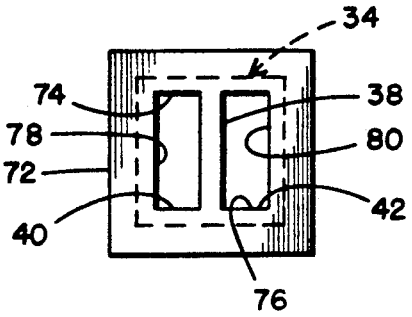
FIG. 2 is a view of a back end of the assembly of FIG. 1, taken along the line 2—2 of FIG. 1.
Figure 3:
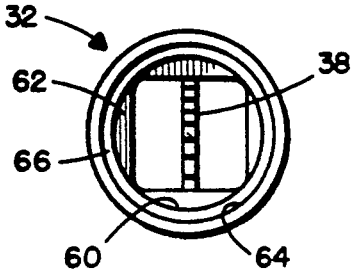
FIG. 3 is a view of a front end of the assembly of FIG. 1, taken along the line 3—3 in FIG. 1.
Figure 4:
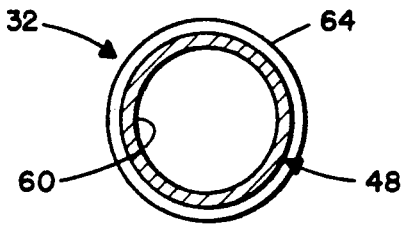
FIGS. 4 and 5 are cross-sectional views taken along the lines 4—4 and 5—5 of the assembly of FIG. 1.
Figure 5:
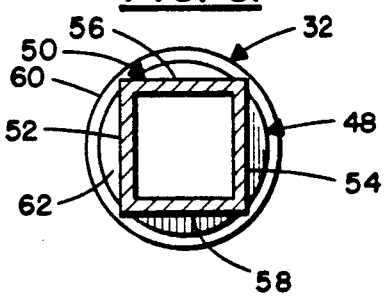

FIGS. 1-8 show a horn radiator assembly 30 which, in accordance with the invention, comprises a circular cylindrical horn 32, a waveguide section 34 of square cross-section, and an impedance matching section 36 which connects a front end of the waveguide section 34 with a back end of the horn 32. The waveguide section 34 includes a septum 38 which extends along a center line of the waveguide section 34, and bisects the back end of the waveguide section 34 to form two ports 40 and 42. A transmit/receive circuit 44, indicated diagrammatically, connects with the ports 40 and 42 for applying linearly polarized radiation to one or both of the ports 40-42 to be converted by the assembly 30 to circularly polarized radiation which radiates as a beam 46 from the horn 32. The assembly 30 operates also in reciprocal fashion such that a circularly polarized wave, incident upon the horn 32, is converted to a linearly polarized electromagnetic wave appearing in either the port 40 or 42, depending on the direction of circular polarization, to be received at the circuit 44.

The impedance matching section 36 comprises a forward section of a waveguide 48 of circular cross-section which connects with a back end of the horn 32, and a rear section of waveguide 50 of square cross-section which interconnects the forward waveguide section 48 with a front end of the waveguide section 34. The diameter of the forward waveguide section 48 is smaller than the diameter of the horn 32. The height of a wall, such as a sidewall 52 of the rear waveguide section 50 is smaller than a diameter of the forward waveguide section 58. The decreasing magnitude of the dimensions of the waveguide sections 48 and 50 relative to the dimension of the horn 32 provides for a stepped configuration to the impedance matching section 36. The square waveguide section 50 includes the aforementioned sidewall 52, and a sidewall 54, and top and bottom walls 56 and 58 which are joined by the sidewalls 52 and 54. The forward waveguide section 48 comprises a cylindrical sidewall 60 and a back wall 62. The horn 32 comprises a cylindrical sidewall 64 and a shelf 66 at an interface between the horn 32 and the forward waveguide section 48. The horn 32 and the impedance matching section 36 are formed integrally as a unitary structure which is provided with a flange 68 at the back end of the impedance matching section 36 for mating with the waveguide section 34 via a flange 70 located at the front end of the waveguide section 34. A further flange 72 is provided at the back end of the waveguide section 34 for connection with other microwave components, such as components of the circuit 44.

In accordance with a feature of the invention, the waveguide section 34 comprises a top wall 74 and a bottom wall 76 which are joined by sidewalls 78 and 80. The septum 38 stands on the bottom wall 76, and extends from a middle portion of the waveguide section 34 towards the back end at the flange 72. At a front end 82 of the septum 38, the septum 38 has a relatively short height, the height extending stepwise, via a succession of steps 84, to a back portion 86 of the septum wherein the septum 38 extends the full height of the waveguide section 34 from the bottom wall 76 to the top wall 74.

Figure 7:
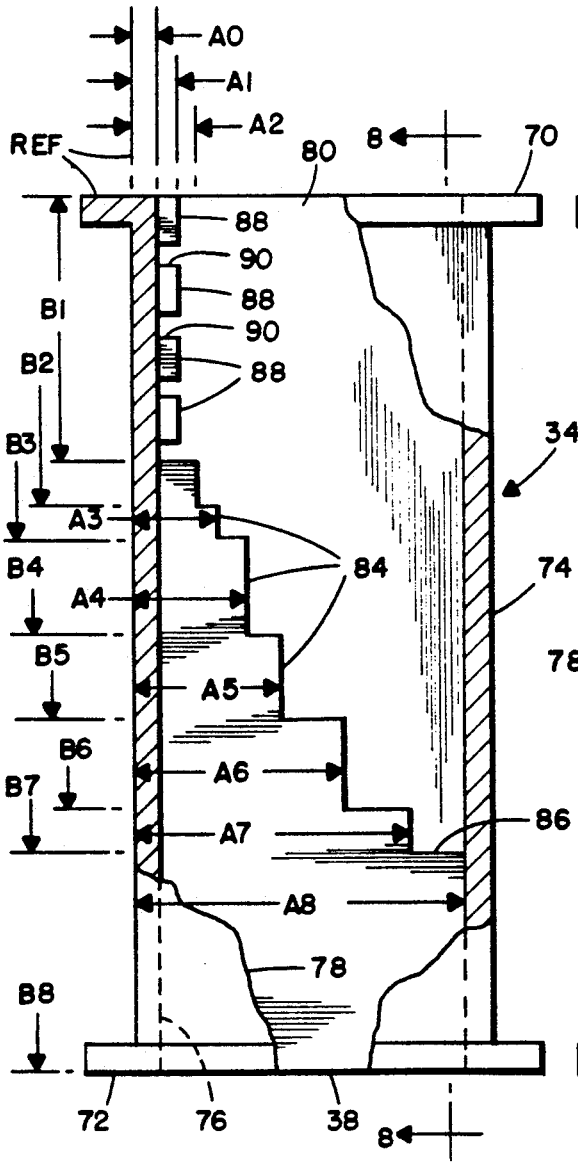
FIG. 7 shows an enlargement of the side elevational view of FIG. 6, a major portion of the view of FIG. 7 being cut away to show a side view of the septum and a side view of a row of capacitive teeth of a waveguide section of the assembly of FIG. 1.
Figure 8:
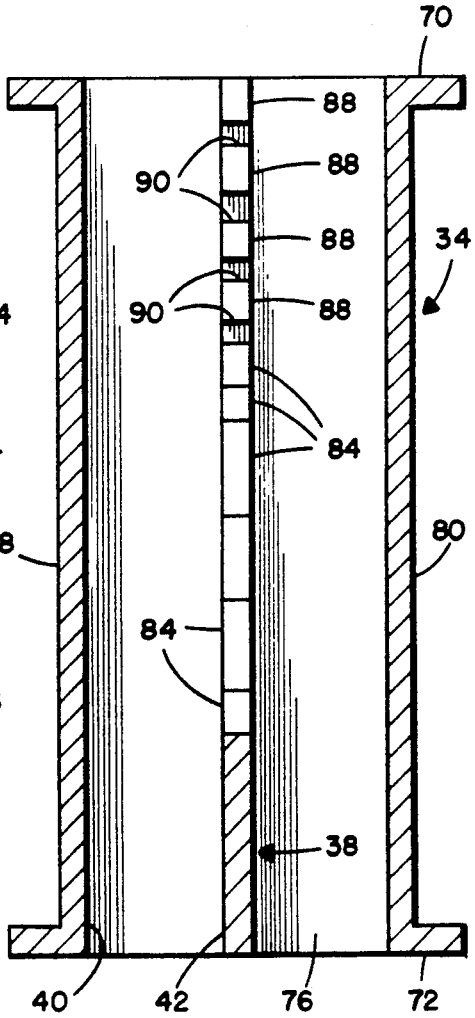
FIG. 8 is a sectional plan view of a waveguide assembly of FIG. 1, the view of FIG. 8 being taken along the line 8—8 in FIG. 7 to show details in the construction of the row of the capacitive teeth and steps of the septum.

The steps 84 are of differing heights and widths. For example, the widths of the steps 84 vary from approximately 0.1 to 0.25 wavelength at a nominal frequency of the electromagnetic radiation propagating through the waveguide section 34. By way of example, in the construction of a preferred embodiment of the invention, the radiator assembly 30 operates over a frequency range of 11.0 to 13.4 GHz (gigahertz) and over a range of 13.7 to 18.0 GHz. In use of the radiator assembly 30, by way of example, a frequency band of 11.7 to 12.2 GHz or a band of 12.2 to 12.7 GHz could be used for transmission; a band of 14.0 to 14.5 GHz or a band of 17.3 to 17.8 GHz could be used for reception, and a band of 15.5 to 16.5 GHz could be used for satellite tracking. For purposes of constructing the preferred embodiment of the radiator assembly 30, a nominal value of frequency of 12.45 GHz is selected, this corresponding to a free-space wavelength of 0.948 inches. The largest dimensions of the steps are found in the middle of the series of steps 84. Smaller dimensions of the steps 84 are found near both ends of the series of the steps 84. Incremental heights of the steps 84 vary from approximately 0.035 to 0.200 wavelengths at the nominal value of the radiation frequency, and the incremental widths of the steps 84 vary from approximately 0.1 to 0.25 wavelengths. The actual heights of the steps 84, as represented by the legends A2-A8 in FIG. 7, are provided relative to a reference plane at the outside edge of the bottom wall 76. The actual locations of the riser portions of each of the steps 84, as represented by the legends B1-B8 in FIG. 7, are provided relative to a reference plane at the front surface of the front flange 70 of the waveguide section 34. The following dimensions are employed in the preferred embodiment of the invention. The dimensions A2, A3, and A4 measure, respectively, 0.080, 0.126, and 0.174 inches. The dimensions A5, A6, A7, and A8 measure, respectively, 0.254, 0.313, 0.572, and 0.614 inches. The dimensions B1, B2, B3, and B4 measure, respectively, 1.017, 1.100, 1.215, and 1.478 inches. The dimensions B5, B6, B7, and B8 measure, respectively, 1.713, 1.958, 2.055, and 2.423 inches. Thus, the smaller step widths are approximately one-tenth wavelength, and the larger step widths are approximately one-quarter wavelength. The septum 38 has a thickness of 0.030 inches.

A characteristic of the septum 38 is that it introduces a phase shift versus frequency to radiation propagating past the septum 38 wherein the phase shift decreases with increasing frequency. Such a phase shift characteristic is similar to that disclosed for a capacitive ridge in U.S. Pat. No. 4,654,611 of Wong et al. In order to provide a broad-band transmission characteristic to the waveguide section 34, as well as to the entire horn radiator assembly 30, a set of teeth 88 are provided upstanding from the bottom wall 76 and are arranged in a line colinear with the septum 38 to introduce capacitance to the waveguide section 34. The capacitance introduced by the teeth 88 has a phase-shift characteristic to radiation propagating in the waveguide section 34 wherein the amount of phase shift increases with increasing frequency of the radiation. Four of the teeth 88 are provided in the preferred embodiment of the invention, the teeth 88 being spaced apart from each other and from the front end 82 of the septum 38 by spaces 90. With increasing frequency of the radiation, the increment in phase shift introduced by the row of teeth 88 tends to cancel the decrement in phase shift introduced by the septum 38 so as to obtain the desired wide bandwidth characteristic of the radiator assembly. In the preferred embodiment of the invention, the teeth 88 have the same height and the same width, and the spaces 90 are all equal. The height of the teeth 88, relative to the reference plane, as designated by the legend A1 in FIG. 7 is 0.047 inches. The thickness of the bottom wall 76, as represented by the legend A0, is 0.040 inches. The teeth 88 are positioned periodically with a period of 0.242 inches as measured between centers of the teeth. The spacing between the teeth 88, as represented by the spaces 90, is 0.095 inches.

In the construction of the horn 32 and the impedance matching section 36, the horn 32 has an axial length, as measured from the shelf 66 to the front of the horn 32, of 0.675 inches. The thickness of the sidewall 64 is 0.007 inches. In the forward waveguide section 48, the axial length, as measured from the back wall 62 to the shelf 66 is 0.310 inches. The axial length of the rear waveguide section 50 is 0.593 inches. The inside diameter of the horn 32 is 1.039 inches. The wall thickness of the forward waveguide section 48 is 0.018 inches. The inside diameter of the forward waveguide section 48 is 0.850 inches. The cross-sectional dimensions of the rear waveguide section 50 are the same as those of the waveguide section 34 wherein the interior wall heights are 0.583 inches. The stepwise construction of the impedance matching section 36 minimizes mutual coupling among horns 32 in an array of radiator assemblies 30 such as that to be described in FIG. 19.

Figure 9A:
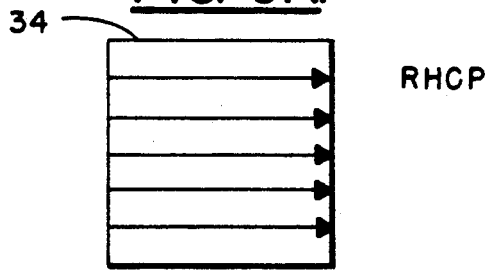
FIGS. 9A–B, 10A–B, 11A–B, 12A–B and 13 constitute a sequence of diagrams of electric fields within the waveguide section of the assembly of FIG. 1 demonstrating the conversion of horizontal and vertical components of a right-handed circularly polarized (RHCP) wave, at a front of the waveguide section, to a single linearly polarized wave at a back port of the waveguide section.
Figure 9B:
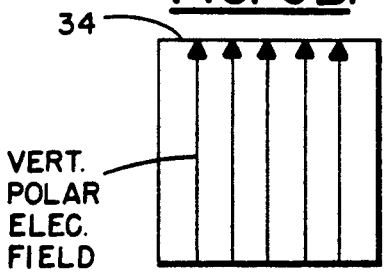

With reference to FIGS. 9A–13, a right-handed circularly polarized wave is presumed to be incident upon the horn 32, the wave having horizontally polarized components of electric field depicted as arrows in FIG. 9A, and vertically polarized components of electric field as depicted by arrows in FIG. 9B. The electric field components represented by FIGS. 9A and 9B occur in the front portion of the waveguide section 34. Upon reaching the steps 84 of the septum 38, changes occur in the electric field components as indicated by FIGS. 10A–10B and FIGS. 11A–11B. FIGS. 10A–10B represent a region of the septum 38 towards the front end of the septum, while FIGS. 11A–11B represent a region of the septum 38 towards the back end of the septum. In FIG. 10A, the horizontally polarized electric field components are reconfigured, the reconfiguration continuing into FIG. 11A wherein the energy of the electric field has now been converted into opposed electric field vectors located on opposite sides of the septum 38 and extending in opposite direction.

Figure 10A:
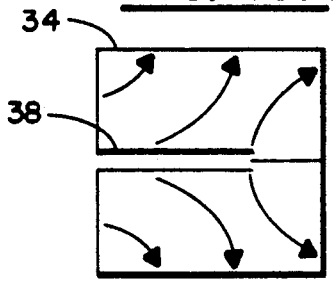
Figure 10B:
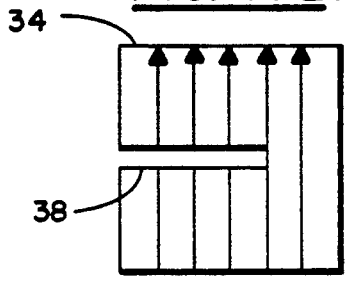
Figure 10B:
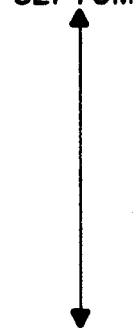
Figure 11A:
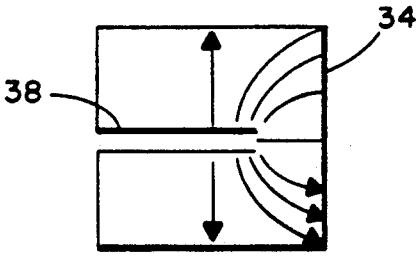
Figure 11B:
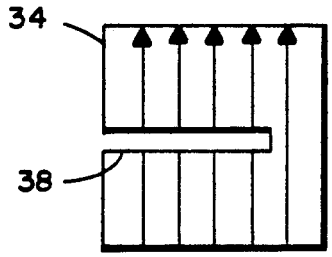
Figure 12A:
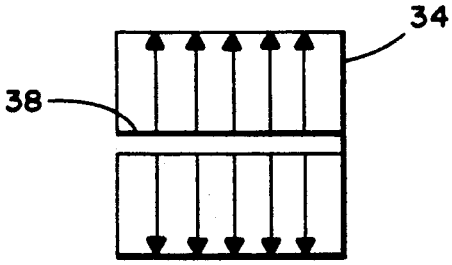
Figure 12B:
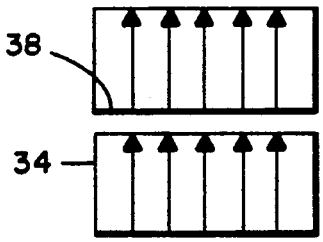
Figure 13:
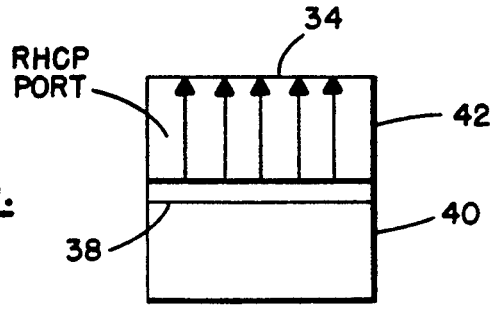

With respect to the vertically polarized electric field components, a part of the electric field appears on each side of the septum 38, as shown in FIGS. 10B and 11B, however, the direction of the electric field vectors remains the same on both sides of the septum 38. At the back portion 86 of the septum 38, the operation of the orthomode transducer (OMT) takes place to combine the electric fields resulting from the horizontally polarized fields of FIG. 9A and the vertically polarized fields of FIG. 9B. FIG. 12A shows the opposed vertical fields on both sides of the septum 38 resulting from the horizontally polarized field of FIG. 9A, and FIG. 12B shows electric fields pointing in the same direction on opposite sides of the septum 38 resulting from the vertically polarized field of FIG. 9B. The amplitudes of the fields of FIG. 9B and FIG. 9A are in phase quadrature to produce the right-handed circular polarization. However, in the transformation of the electric fields represented by FIGS. 10A, 11A, and 12A, there has been a phase shift of 90 degrees which brings the amplitudes of the electric fields of FIGS. 12A in phase with the amplitudes of the electric fields in FIG. 12B. This results in a summation of the commonly directed fields of FIG. 12B, and a cancellation of the opposed fields of FIG. 12A to produce, in FIG. 13, a vertically polarized electric field in the port 42 with essentially no radiation being present in the port 40.

Figure 14A:
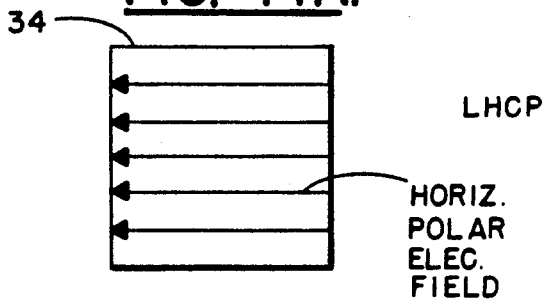
FIGS. 14A-B, 15A-B, 16A-B, 17A-B, and 18 constitute a sequence of diagrams of electric fields within the waveguide section of the assembly of FIG. 1 demonstrating the conversion of horizontal and vertical components of a left-handed circularly polarized (LHCP) wave, at a front of the waveguide section, to a single linearly polarized wave at an alternate port at the back end of the waveguide section.
Figure 14B:
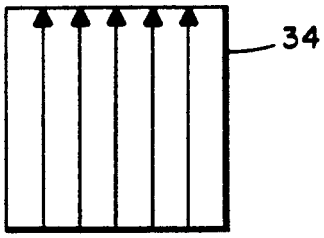
Figure 15A:
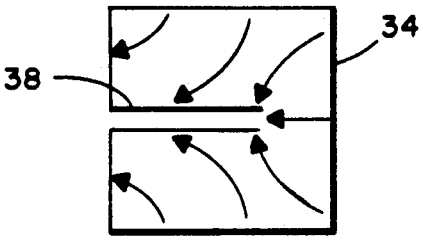
Figure 15B:
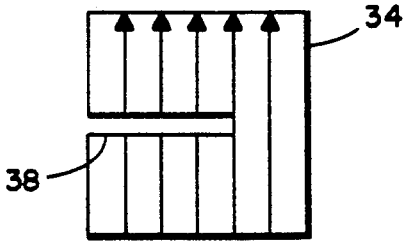
Figure 15B:
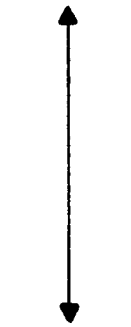
Figure 16A:
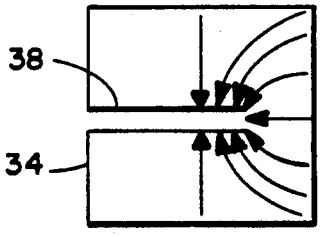
Figure 16B:
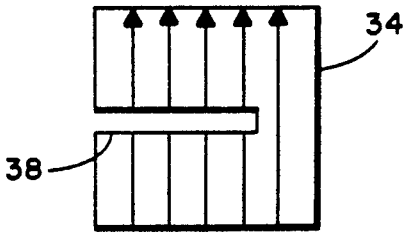
Figure 17A:
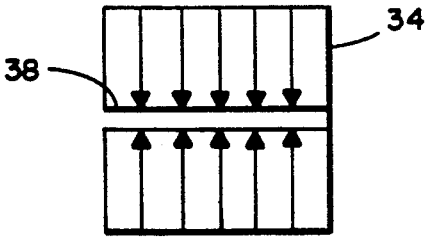
Figure 17B:
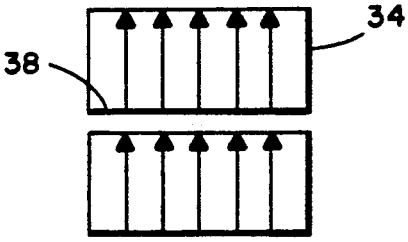
Figure 18:
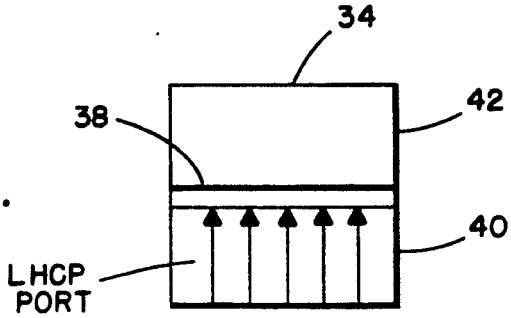

The FIGS. 14A–18 provide a description of the operation of the waveguide section 34 for the case of the left-handed circularly polarized (LHCP) electromagnetic wave. The vectorial representations of the electric fields of FIGS. 14B, 15B, 16B, and 17B are the same as the electric fields portrayed in the FIGS. 9B, 10B, 11B, and 12B, respectively. In FIG. 14A, the electric field vectors are oriented in the opposite sense to the electric field vectors of FIG. 9A. Similarly, in FIGS. 15A, 16A, and 17A, the electric fields have the same patterns as do the fields of FIGS. 10A, 11A, and 12A, respectively, but are oriented in the opposite sense. As a result, there is a summation of vectors to produce the electric fields in port 40, while there is a cancellation of electric fields to produce essentially no electric fields in port 42 of FIG. 18. Thus, upon comparing FIGS. 13 and 18, it is noted that an electric field is received in port 42 in the case of right-handed circularly polarized waves, while for a received left-handed circularly polarized wave, the electric fields are presented in port 40. Since the operation of the radiator assembly 30 is reciprocal, the assembly 30 is operative to transmit a right-handed circularly polarized wave by applying the electric field to port 42 and, for transmission of a left-handed circularly polarized wave, the electric field is to be applied to port 40. In this manner, the transmit receive circuit 44 of FIG. 1 can provide for either a right-handed or left-handed circularly polarized wave by applying the electric field respectively to either port 42 or Port 40. Coupling of the circuit 44 to the port 40 (FIGS. 1–2) is provided via line 92, and the coupling of the circuit 44 to the port 42 is provided by line 94.

Figure 19:
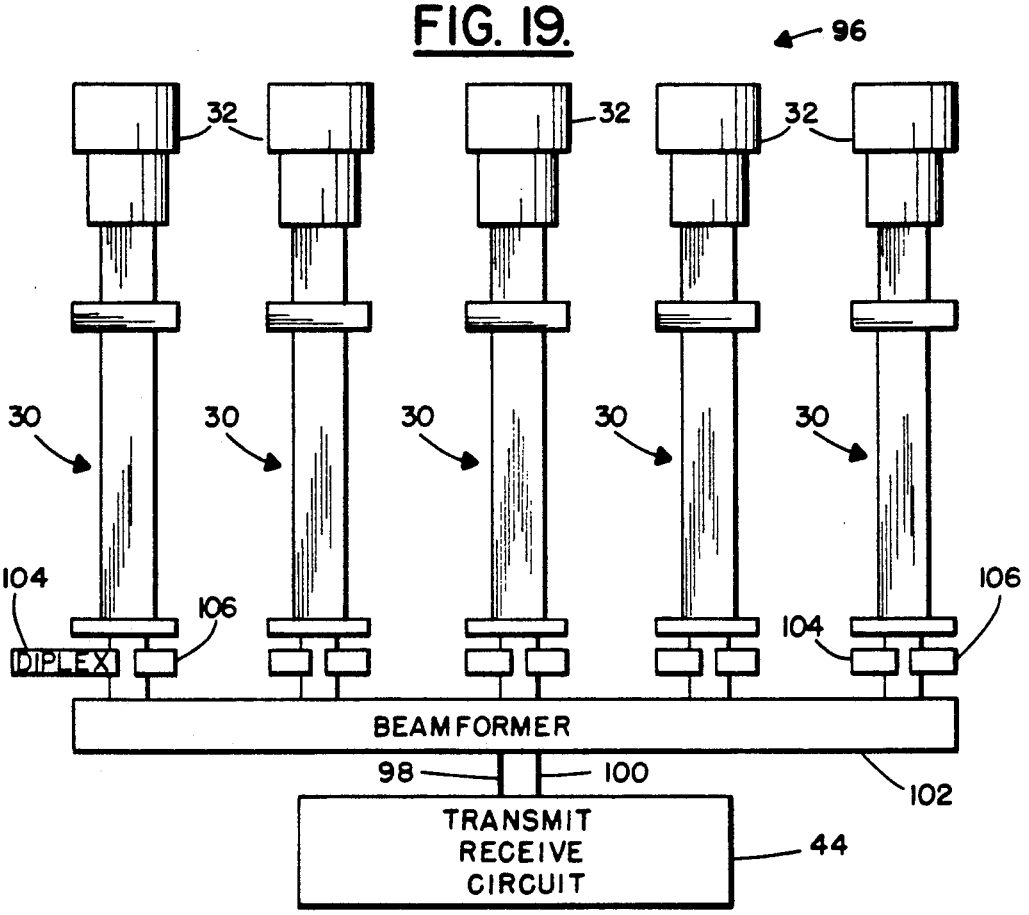
FIG. 19 is a block diagram showing connection of an array of horn radiator assemblies, each having the construction of FIG. 1, to a beamformer of an array antenna.

FIG. 19 shows an antenna 96 comprising an array of radiator assemblies 30 with their horns 32 arranged side-by-side to produce a beam of radiation for transmission and reception of radiant signals. The transmit/-receive circuit 44 is coupled via lines 98 and 100 to a beamformer 102. The beamformer 102 connects with the ports 40 and 42 of each of the radiator assemblies 30 via diplexers 104 and 106 to allow operation of transmit and receive functions in different portions of the frequency bands over which the radiator assemblies 30 are operative. In accordance with well-known circuitry, the beamformer 102 is operative to provide phase shift and/or delays of signals applied to one of the radiator assemblies 30 relative to other ones of the radiator assemblies 30 so as to form and to direct a beam of radiation produced by the horns 32. The beamformer 102 is operative to divide power equally among the radiator assemblies 30 for the transmission of radiation, and to combine the power of radiant signals received from the radiator assemblies 30 during reception of an incoming electromagnetic signal. By selection of either the port 40 or the port 42, respectively, in each of the radiator assemblies 30, a left-handed or right-handed circularly polarized wave can be transmitted or received.

Figure 20:
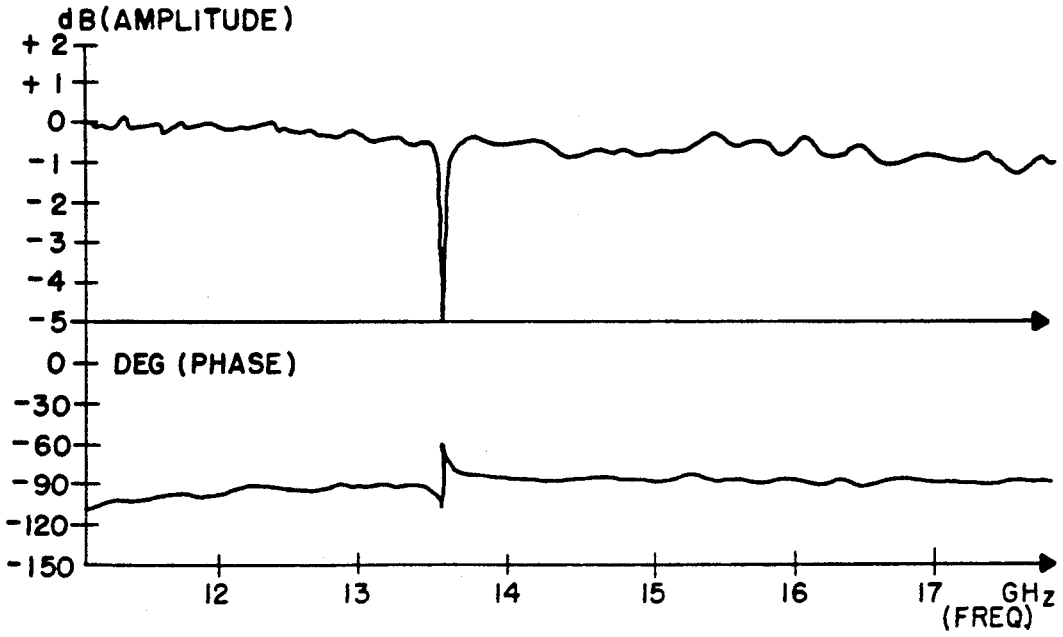
FIG. 20 is a graph showing frequency response of a horn radiator assembly of FIG. 1, the graph showing both phase and amplitude of a signal transmitted via the horn radiator assembly.

FIG. 20 shows a graph representing the frequency response of a horn radiator assembly 30. The graph includes two traces, the upper trace representing amplitude of a transmitted or received signal as a function of frequency, and the lower trace representing phase shift of the transmitted or received signal as a function of frequency. The amplitude variations are indicated in decibels, the phase shift is indicated in degrees, and the frequency is presented in units of gigahertz. A region of attenuation and rapid phase shift occurs in a relatively narrow frequency band centered at a frequency of approximately 13.5 GHz. This divides the useful spectrum of the radiator assembly 30 into a lower frequency band and a higher frequency band.

As disclosed above, the invention provides for a radiator assembly 30 having a smaller overall configuration than has been possible heretofore. A significant savings in space, over that of previous microwave structures, is afforded by the lack of tuning screws, by the parallel arrangement of the two waveguide ports 40 and 42, and by the reduction in overall length of the septum 38 through use of the numerous steps 84. The use of the numerous steps 84 also provides for a significant reduction in reflected waves, and the use of the capacitive teeth 88 serves to provide the desired broad bandwidth. The reduction in size facilitates construction of the array antenna 96, and the stepped configuration of the impedance matching structure 36 reduces mutual coupling between the radiating horns 32 of the antenna 96.

It is to be understood that the above described embodiment of the invention is illustrative only, and that modifications thereof may occur to those skilled in the art. Accordingly, this invention is not to be regarded as limited to the embodiment disclosed herein, but is to be limited only as defined by the appended claims.

What is claimed is:

1. A horn radiator assembly comprising:

a waveguide section having a front end and a back end and being of square cross-section, said waveguide section having a top wall and a bottom wall, there being a middle portion of said waveguide section located between said front end and said back end;

a septum upstanding from said bottom wall within said waveguide section, said septum extending from said middle portion of said waveguide section in longitudinal direction toward said back end and increasing in height stepwise with progression toward said back end, a maximum height of said septum extending from said bottom wall to said top wall enabling said septum to bisect a portion of said waveguide section into first and second waveguide ports of rectangular cross section;

a circular cylindrical horn having a front end and a back end spaced apart along a longitudinal axis of said horn, a radiating aperture being located at said front end of said horn, said back end of said horn being coupled to said front end of said waveguide section; and wherein a circularly polarized wave entering said radiator assembly via said horn exits said radiator assembly as a linearly polarized wave via said first port for right-handed circular polarization and via said second port for left-handed circular polarization of said circularly polarized wave.

2. A horn radiator assembly according to claim 1 further comprising an array of teeth upstanding from said bottom wall in said waveguide section, said teeth providing capacitance for said waveguide section and being arranged in a row extending in longitudinal direction from said front end of said waveguide section to said middle portion of said waveguide section.

3. A horn radiator assembly according to claim 1 further comprising an impedance matching section disposed between said back end of said horn and said front end of said waveguide section, said impedance matching section comprising a second waveguide section and a third waveguide section connecting respectively with said horn and said first-mentioned waveguide section, said second waveguide section having a circular cross section of smaller diameter than said horn, said third waveguide section having a cross section equal to a cross section of said front end of said first waveguide section and a sidewall height smaller than the diameter of said second waveguide section.

4. A horn radiator assembly according to claim 3 further comprising an array of teeth upstanding from said bottom wall in said first waveguide section, said teeth providing capacitance and being arranged in a row extending in longitudinal direction from said front end to said middle portion of said first waveguide section.

5. A horn radiator assembly according to claim 4 wherein said septum has multiple steps in a series of steps of which a first step is higher than said teeth of said array of teeth, and a last of said steps brings said septum in contact with said top wall.

6. A horn radiator assembly according to claim 5 wherein each step of said septum extends approximately one-tenth or one-quarter of a nominal value of wavelength of radiation propagating past said septum to reduce reflection of a wave of the radiation.

7. A horn radiator assembly according to claim 6 wherein the incremental height of individual ones of said steps closer to said bottom wall is greater than the incremental height of individual ones of said steps in a middle portion of said series of steps.

8. An array antenna comprising a beamformer and a plurality of horn radiator assemblies coupled to said beamformer, each of said horn radiator assemblies comprising:

a waveguide section having a front end and a back end and being of square cross-section, said waveguide section having a top wall and a bottom wall, there being a middle portion of said waveguide section located between said front end and said back end;

a septum upstanding from said bottom wall within said waveguide section, said septum extending from said middle portion of said waveguide section in longitudinal direction toward said back end and increasing in height stepwise with progression toward said back end, a maximum height of said septum extending from said bottom wall to said top wall enabling said septum to bisect a portion of said waveguide section into first and second waveguide ports of rectangular cross section; and a circular cylindrical horn having a front end and a back end spaced apart along a longitudinal axis of said horn, a radiating aperture being located at said front end of said horn, said back end of said horn being coupled to said front end of said waveguide section.

9. An array antenna according to claim 8 further comprising an array of teeth upstanding from said bottom wall in said waveguide section, said teeth providing capacitance for said waveguide section and being arranged in a row extending in longitudinal direction from said front end of said waveguide section to said middle portion of said waveguide section.

10. An array antenna according to claim 8 further comprising an impedance matching section disposed between said back end of said horn and said front end of said waveguide section, said impedance matching section comprising a second waveguide section and a third waveguide section connecting respectively with said horn and said first-mentioned waveguide section, said second waveguide section having a circular cross section of smaller diameter than said horn, said third waveguide section having a cross section equal to a cross section of said front end of said first waveguide section and a sidewall height smaller than the diameter of said second waveguide section; and wherein said impedance matching structure minimizes mutual coupling among horns of respective ones of said radiator assemblies.

11. An array antenna according to claim 10 further comprising an array of teeth upstanding from said bottom wall in said first waveguide section, said teeth providing capacitance and being arranged in a row extending in longitudinal direction from said front end of said first waveguide section to said middle portion of said first waveguide section.

* * * * *